US009109385B2

(12) United States Patent
Goldstein

(10) Patent No.: US 9,109,385 B2
(45) Date of Patent: Aug. 18, 2015

(54) TOOL AND METHOD FOR ADJUSTING A HINGE

(71) Applicant: Steven M. Goldstein, Herald, CA (US)

(72) Inventor: Steven M. Goldstein, Herald, CA (US)

(73) Assignee: Steven M. Goldstein, Herald, CA (US)

( * ) Notice: Subject to any disclaimer, the term of this patent is extended or adjusted under 35 U.S.C. 154(b) by 239 days.

(21) Appl. No.: 13/966,240

(22) Filed: Aug. 13, 2013

(65) Prior Publication Data

US 2015/0047169 A1 Feb. 19, 2015

(51) Int. Cl.

| | |
|---|---|
| ***E05D 7/00*** | (2006.01) |
| ***B21D 1/14*** | (2006.01) |
| ***B21D 1/06*** | (2006.01) |

(52) U.S. Cl.

CPC ..... *E05D 7/0018* (2013.01); *B21D 1/06* (2013.01); *B21D 1/14* (2013.01); *E05Y 2600/12* (2013.01); *E05Y 2600/56* (2013.01); *E05Y 2900/132* (2013.01)

(58) Field of Classification Search

USPC ..... 72/457, 479, 458; 81/165, 186, 427.5

See application file for complete search history.

(56) References Cited

U.S. PATENT DOCUMENTS

| | | | | |
|---|---|---|---|---|
| 4,619,132 | A | 10/1986 | McBee | |
| 5,435,030 | A | 7/1995 | Phillips | |
| 5,875,535 | A | 3/1999 | Canoy | |
| 6,257,101 | B1 * | 7/2001 | Marlette et al. | 81/165 |
| 6,450,003 | B1 | 9/2002 | Pawson | |
| 6,725,703 | B1 * | 4/2004 | Johnson | 72/458 |
| 6,769,284 | B1 * | 8/2004 | Dennis | 72/457 |
| 7,188,509 | B1 * | 3/2007 | Goldstein | 72/457 |

* cited by examiner

*Primary Examiner* — David B Jones

(74) *Attorney, Agent, or Firm* — Kali Law Group, P.C.

(57) ABSTRACT

Tools for grasping and aligning a number of knuckles of a hinge are presented, the tool including: a tube having a bore and a slotted opening in a side of the tube connecting with the bore and parallel thereto, where the bore extends from one end of she tube to another end of the tube, and where the bore includes a diameter sufficient to permit telescoping the tube onto the number of knuckles; a stop located along one end of the tube and perpendicular thereto; sad a pair of flattened surfaces formed along an outside surface of the tube and opposite one another, where the pair of flattened surfaces are configured to receive a leveraging tool. In some embodiments, the flattened surfaces include: a raised flattened surface and an indented flattened surface.

14 Claims, 3 Drawing Sheets

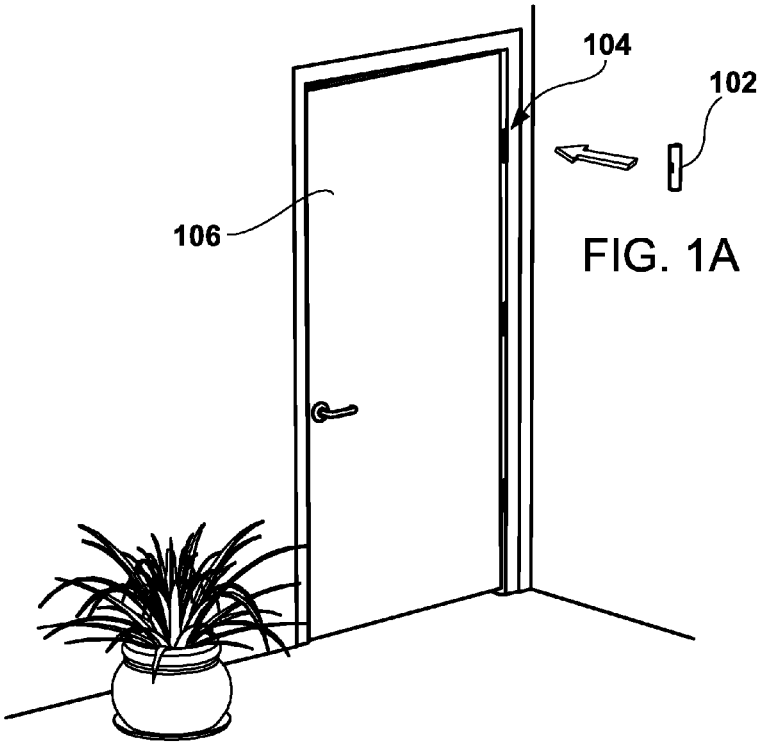
FIG. 1A
FIG. 1B
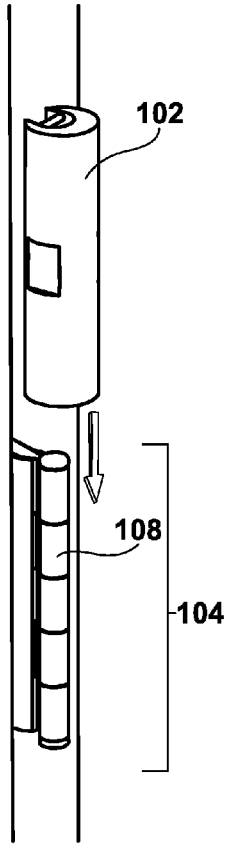
FIG. 1D
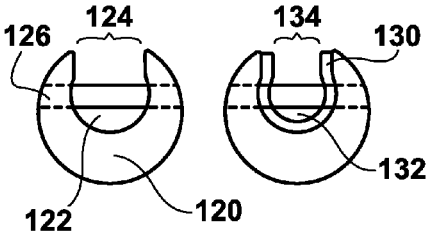
FIG. 1C
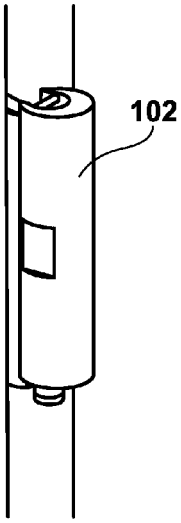
FIG. 1E
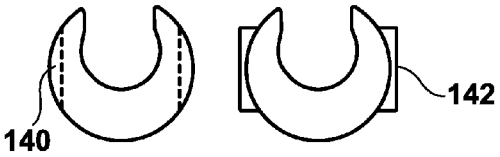

TOOL AND METHOD FOR ADJUSTING A HINGE

FIELD OF INVENTION

This invention relates to adjusting hinges and particularly to a tool that slides onto an installed hinge and may be utilized to adjust the hinge.

BACKGROUND

A typical hinge includes two hinge plates, and a hinge pin. Each hinge plate, has one or more knuckles that are aligned and interleaved with the one or more knuckles of the other hinge plate. The hinge pin passes through the knuckles secures the hinge plates together. A bend in each hinge plate (called a "swage") is formed in order that, when the door is closed, the door will close properly. However, as the door ages, and even oftentimes with new doors, the door will not close properly.

A number of devices have been disclosed related to the mounting of doors on door frames with hinges.

For example, U.S. Pat. No. 5,875,535 to Cannoy discloses a hinge pin removal tool comprising an elongated handle with as extension having a wedge shaped tip and pin for loosening the pin and driving the loosened pin from the knuckles of the hinge.

U.S. Pat. No. 5,435,030 to Phillips discloses a tool for performing three functions. A punch mounted orthogonally near one handle is used initially to dislodge the pin from the knuckle. The other end of the handle has a wrench-like spanner configuration that is engaged with the hinge. Force is applied to the handle to straighten bends in the hinge. The magnitude of force applied by the carpenter directly against the tool to bend the hinge is a matter of the carpenter's judgment so that the adjustment is not accurate. Such misalignment generally originates in the "swage" in the door hinge. In the context of this specification, the term "swage" (a common term in the art of door hinges) means the offset of the axis of the knuckles of each hinge plate from the plane of the respective hinge plate that enables the two hinge plates to rotate to flush against one another.

U.S. Pat. No, 4,619,132 to Henderson et al discloses a flat bar (strap) with a bent portion on each end of the bar. Each bent portion has a notch for engaging the top or bottom flange of a hinge permitting a carpenter to apply a bending force to straighten the hinge. None of these disclosures addresses the problem of misalignment of the door hinge that can occur after the door is hung.

U.S. Pat. No. 6,450,003 to Pawson discloses a sliding door hinge tool that may be utilized to adjust a door hinge after installation. Pawson's tool allows swage to be adjusted solely by opening a door on which the tool has been placed. However, in cases where a glass door is utilized, forces exerted by the tool may unduly stress glass panels.

As such, tools and methods for adjusting a hinge are provided herein.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

As such tools for grasping and aligning a number of knuckles of a hinge are presented, the tool including: a tube having a bore and a slotted opening in a side of the tube connecting with the bore and parallel thereto, where the bore extends from one end of the tube to another end of the tube, and where the bore includes a diameter sufficient to permit telescoping the tube onto the number of knuckles; a stop located along one end of the tube and perpendicular thereto; and a pair of flattened surfaces formed along an outside surface of the tube and opposite one another, where the pair of flattened surfaces are configured to receive a leveraging tool. In some embodiments, the flattened surfaces include: a raised flattened surface and an indented flattened surface. In some embodiments, tools further include an insert selected to provide a non-marring surface, the insert having an insert bore and an insert slotted opening in an insert side of the insert connecting with the insert bore and parallel thereto, where the insert bore extends from one end of the insert to another end of the insert, where the insert bore includes an insert diameter sufficient to permit telescoping the insert onto the number of knuckles, and where the insert includes an outer diameter sufficient to permit telescoping the insert into the bore of the tube. In some embodiments, the insert includes: a polymeric material, a brass material, an aluminum material, and a rubberized material.

In other embodiments, tools for grasping and aligning a number of knuckles of a hinge are presented, the tool including: a tube having a bore and a slotted opening in a side of the tube connecting with the bore and parallel thereto, where the bore extends from one end of the tube to another end of the tube, and where the bore includes a diameter sufficient to permit telescoping the tube onto the number of knuckles; a stop located along one end of the tube and perpendicular thereto; and an additional bore located along an outside surface of the tube and opposite the slotted opening, where the additional bore is configured to receive a leveraging tool. In some embodiments, tools further include an insert selected to provide a non-marring surface, the insert having an insert bore and an insert slotted opening in an insert side of the insert connecting with the insert bore and parallel thereto, where the insert bore extends from one end of the insert to another end of the insert, where the insert bore includes an insert diameter sufficient to permit telescoping the insert onto the number of knuckles, and where the insert includes an outer diameter sufficient to permit telescoping the insert into the bore of the tube.

In other embodiments, methods for aligning a swage of each one of a pair of hinge plates of a hinge with one another are presented including: providing a tool, the tool including, a tube having a bore and a slotted opening in a side of the tube connecting with the bore and parallel thereto, where the bore extends from one end of the tube to another end of the tube, and where the bore includes a diameter sufficient to permit telescoping the tube onto a number of knuckles of the hinge, a stop located along one end of the tube and perpendicular thereto, and a pair of flattened surfaces formed along an outside surface of the tube and opposite one another, where the pair of flattened surfaces are configured to receive a leveraging tool; telescoping the tool onto the number of knuckles until the stop contacts a topmost knuckle; providing the leveraging tool; locating the leveraging tool along the pair of flattened surfaces; and applying a directional force to the leveraging tool sufficient to deform the number knuckles thereby aligning the swage. In some embodiments, methods further include removing the tool from the hinge. In some embodiments, methods further include before the telescoping the tool onto the number of knuckles, telescoping an insert into the tool, the insert selected to provide a non-marring surface, the insert having an insert bore and an insert slotted opening in an insert side of the insert connecting with the insert bore and parallel thereto, where the insert bore extends from one end of the insert to another end of the insert, where the insert bore includes an insert diameter sufficient to permit telescoping the insert onto the number of knuckles, and where the insert includes an outer diameter sufficient to permit telescoping the insert into the bore of the tube.

BRIEF DESCRIPTION OF THE DRAWINGS

The present invention is illustrated by way of example, and not by way of limitation, in the figures of the accompanying drawings and to which like reference numerals refer to similar elements and in which:

FIGS. 1A-1F are illustrative representations of tools tor adjusting a hinge in accordance with embodiments of the present invention;

DETAILED DESCRIPTION

Figure 2A:
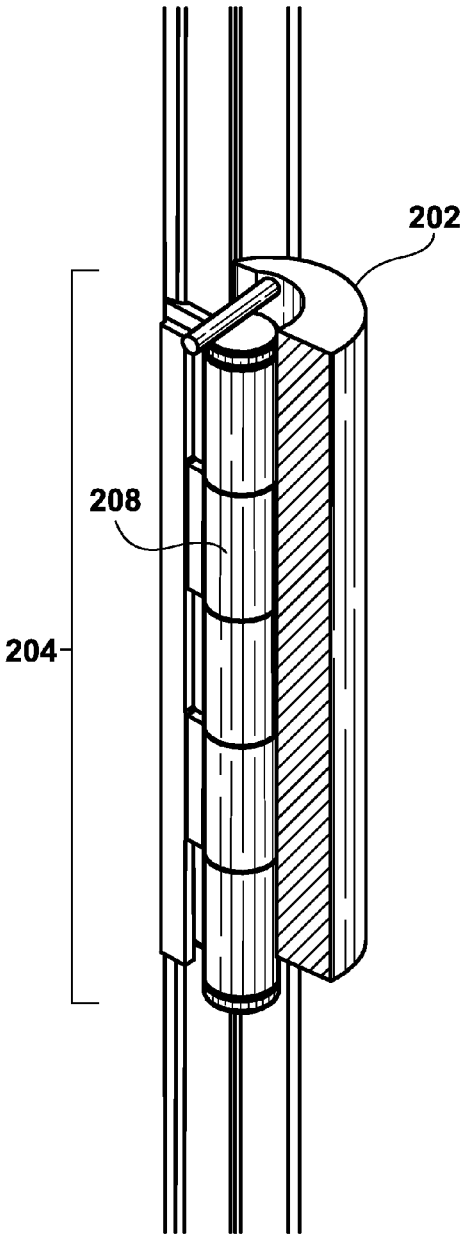
FIGS. 2A-2C are illustrative cut-away representations of tools for adjusting a hinge in accordance with embodiments of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

FIGS. 1A-1E are illustrative representations of tools for adjusting a hinge in accordance with embodiments of the present invention. In particular, FIG. 1A illustrates an example where tool 102 may be utilized. In this example, tool 102 may be utilized to adjust door hinge 104 of door 106. It may be appreciated that hinges exist for many applications including doors, lids, hatches, gates, and the like. As such, it may be appreciated that embodiments provided herein may be utilized to adjust any number of hinge applications. FIG. 1B illustrates tool 102 positioned above hinge 104. As may be seen hinge 104 may include a number of interleaved knuckles 108 over which tool 102 may telescopically slide or slidingly engage. FIG. 1C illustrates tool 102 installed on hinge 104 and ready for use in adjusting hinge 104.

FIG. 1D illustrates a top view of tool 102. As illustrated, tool 102 includes tube 120 having bore 122 and slotted opening 124 on a side of tube 120, connecting with bore 122, and parallel thereto. In embodiments, bore 122 extends the length of tube 102. It may be further appreciated that in embodiments, the bore includes a diameter sufficient to permit telescoping the tube onto a number of knuckles 108 such as illustrated in FIG. 1B. Tool 102 further includes stop 126 located along one end of tube 120 and disposed perpendicular thereto. Although a pin stop is illustrated, any manner of stop configurations may be utilized without departing from embodiments provided herein. Further illustrated is insert 130. It may be appreciated that an insert may be utilized to provide a non-marring surface. As utilized herein, the term non-marring surface refers to a surface provided that will not mar or otherwise damage a knuckle during use of embodiments provided herein. As may be appreciated by one skilled in the art, non-marring surfaces are typically surfaces that are softer that contact surfaces. Additionally, an insert may be utilized to accommodate various knuckle sizes and shapes. Insert 130 may include insert bore 132 and insert slotted opening 134 at an insert side of insert 130, connecting with insert bore 132, and parallel thereto. In embodiments, insert bore 132 extends the length of insert 130. Further, in embodiments, the insert bore includes an insert diameter sufficient to permit telescoping or slidingly engaging the insert onto the plurality of knuckles, and an outer diameter sufficient to permit telescoping or slidingly engaging the insert into bore 122 of the tube 120. In some embodiments, inserts may be a material such as: a polymeric material, a brass material, an aluminum material, and a rubberized material without limitation.

FIG. 1E illustrates a cross-sectional view of tool 102. As illustrated, tool 102 includes at least one pair of flattened surfaces 140 and 142 formed along an outside surface of the tube and opposite one another. Flattened surface embodiments may include indented flattened surfaces 140 and raised flattened surfaces 142 without limitation. Each of the illustrated flattened surfaces may be configured to receive a leveraging tool known in the art. In some embodiments such as those illustrated, flattened surfaces may provide parallel surfaces with respect to one another. In other embodiments not illustrated, flattened surfaces may provide sloping surfaces with respect to one another. It may be appreciated that embodiments illustrated provide for a leveraging tool to be utilized in combination with hinge tools to pry or force a hinge in one direction or the other. In some embodiments not illustrated, an additional bore located along an outside surface of the tube and opposite the slotted opening may be utilized and configured to receive a leveraging tool. Additional bores may be smooth or threaded without departing from embodiments provided herein. In some embodiments (not shown) flattened surfaces may included a raised surface and an indented surface configured to offset the axis of rotation of the tool thereby providing off-axis leverage, which may be desirable in some examples.

Figure 2B:
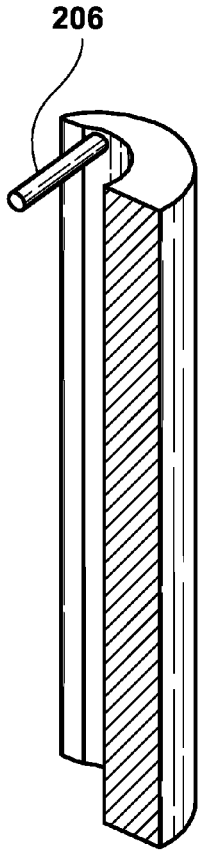
Figure 2C:
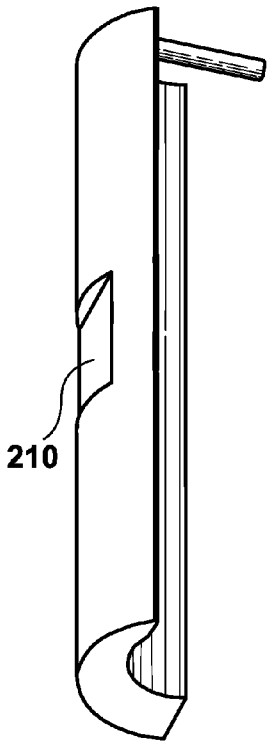

FIGS. 2A-2C are illustrative cut-away representations of tools for adjusting a hinge in accordance with embodiments of the present invention. In particular, FIG. 2A illustrates a cut-away representation of tool 202 installed over hinge 204. As illustrated, tool 202 includes a tube having a bore and a slotted opening on a side of the tube connecting with the bore, and parallel thereto. It may be seen that the bore extends the length of the tube. It may be further appreciated that in embodiments, the bore includes a diameter sufficient to permit telescoping or slidingly engaging the tube onto a number of knuckles 208 as illustrated. As illustrated in FIG. 2B, tool 202 further includes stop 206 located along one end of the tube and disposed perpendicular thereto. Although a pin stop is illustrated, any manner of stops may be utilized without departing from embodiments provided herein. As illustrated in FIG. 2C, tool 102 includes at least one pair of flattened surfaces 210 formed along an outside surface of the tube and opposite one another. Flattened surface embodiments may include indented flattened surfaces 210 and raised flattened surfaces (not shown) without limitation. The illustrated flattened surface may be configured to receive any leveraging tool known in the art without departing from embodiments provided herein. In some embodiments, flattened surfaces may provide parallel surfaces with respect to one another. In other embodiments, flattened surfaces may provide sloping surfaces with respect to one another. It may be appreciated that embodiments illustrated provide for a leveraging tool to be utilized in combination with hinge tools to pry or force a hinge in one direction or the other thereby adjusting the swage of the hinge. In some embodiments (not shown) flattened surfaces may included a raised surface and an indented surface configured to offset the axis of rotation of the tool thereby providing off-axis leverage, which may be desirable in some examples.

Figure 3A:
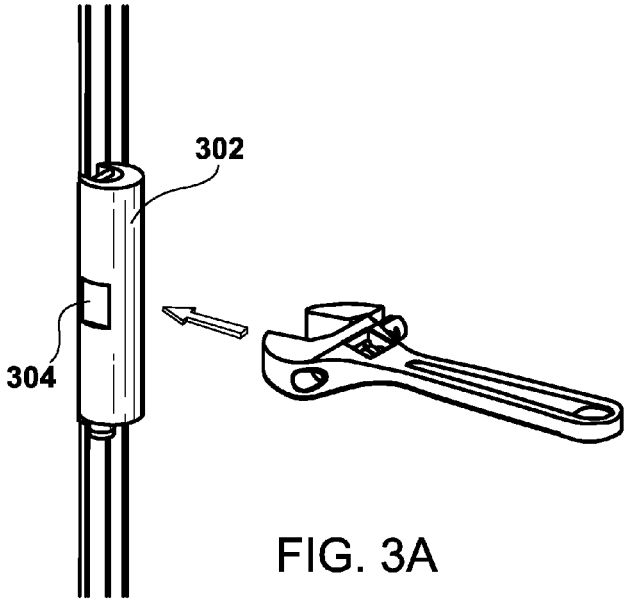
FIGS. 3A-3C are illustrative representations of methods for utilizing tools for adjusting a hinge in accordance with embodiments of the present invention.
Figure 3B:
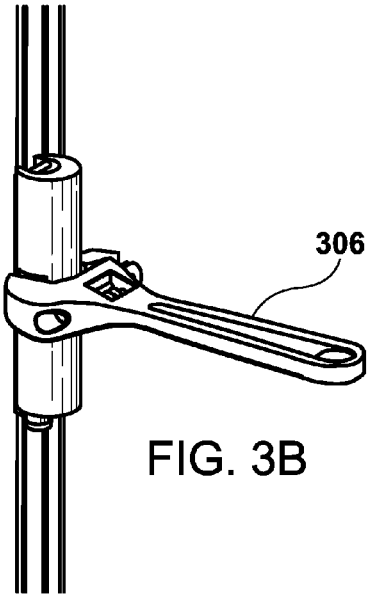
Figure 3C:
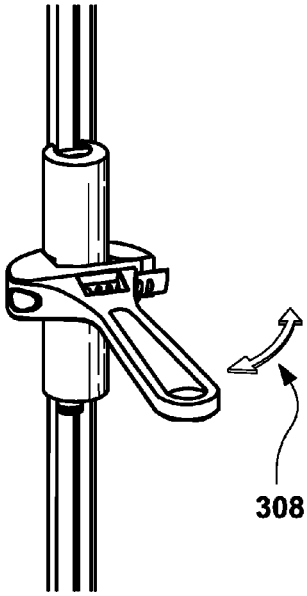

FIGS. 3A-3C are illustrative representations of methods for utilizing tools for adjusting a hinge in accordance with embodiments of the present invention. In particular, FIG. 3A illustrates providing tool 302 which may be telescoped or slidingly engaged onto a number of knuckles of a hinge until a stop contacts the topmost knuckle. Tool embodiments provided may include a tube having a bore and a slotted opening in a side of the tube connecting with the bore and parallel thereto, where the bore extends the length of the tube, and where the bore includes a diameter sufficient to permit telescoping the tube onto a plurality of knuckles of the hinge as illustrated, a stop located along one end of the tube and perpendicular thereto, and a pair of flattened surfaces 304 formed along an outside surface of the tube and opposite one another.

FIG. 3B illustrates locating leveraging tool 306 along flattened surfaces 204 formed along the outside surface of the tube. Flattened surface embodiments, as noted above, may include indented flattened surfaces or raised flattened surface without limitation. In the illustrated example, an adjustable end wrench is shown, however flattened surfaces may be configured to receive any leveraging tool known in the art without departing from embodiments provided herein. In some embodiments, flattened surfaces may provide parallel surfaces with respect to one another. In other embodiments, flattened surfaces may provide sloping surfaces with respect to one another. FIG. 3C illustrates moving leveraging tool 306 in either direction as illustrated by arrow 308 to pry or force a hinge in one direction or the other thereby adjusting the swage of the hinge. It may be noted that usage of embodiments provided herein adjust swage more or less evenly by adjusting all knuckles simultaneously and in a single plane of movement. In some embodiments, additional removable stops may be provided to adjust fewer knuckles simultaneously. Methods further include removing the tool from the hinge. In some embodiments methods may further include utilizing an insert as disclosed above. An insert may be utilized to accommodate different knuckle sizes or to provide a non-marring surface in some embodiments.

While this invention has been described in terms of several embodiments, there are alterations, permutations, and equivalents, which fall within the scope of this invention. It should also be noted that there are many alternative ways of implementing the methods and apparatuses of the present invention. Furthermore, unless explicitly stated, any method embodiments described herein are not constrained to a particular order or sequence. Further, the Abstract is provided herein for convenience and should not be employed to construe or limit the overall invention, which is expressed in the claims. It is therefore intended that the following appended claims be interpreted as including all such alterations, permutations, and equivalents as fall within the true spirit and scope of the present invention.

What is claimed is:

1. A tool for grasping and aligning a plurality of knuckles of a hinge, the tool comprising:

a tube having a bore and a slotted opening in a side of the tube connecting with the bore and parallel thereto, wherein the bore extends from one end of the tube to another end of the tube, and wherein the bore includes a diameter sufficient to permit telescoping the tube onto the plurality of knuckles;

a stop located along one end of the tube and perpendicular thereto; and at least one pair of flattened surfaces formed along an outside surface of the tube and opposite one another, wherein the at least one pair of flattened surfaces are configured to receive a leveraging tool.

2. The tool of claim 1, wherein the flattened surfaces are selected from the group consisting of: a raised flattened surface and an indented flattened surface.

3. The tool of claim 1, further comprising:

an insert selected to provide a non-marring surface, the insert having an insert bore and an insert slotted opening in an insert side of the insert connecting with the insert bore and parallel thereto, wherein the insert bore extends from one end of the insert to another end of the insert, wherein the insert bore includes an insert diameter sufficient to permit telescoping the insert onto the plurality of knuckles, and wherein the insert includes an outer diameter sufficient to permit telescoping the insert into the bore of the tube.

4. The tool of claim 3, wherein the insert is selected from a material selected from the group consisting of: a polymeric material, a brass material, an aluminum material, and a rubberized material.

5. The tool of claim 1, wherein each of the at least one pair of flattened surfaces comprise a parallel surface with respect to one another.

6. The tool of claim 1, wherein each of the at least one pair of flattened surfaces comprise a sloping surface with respect to one another.

7. The tool of claim 1, wherein the hinge is a door hinge.

8. A tool for grasping and aligning a plurality of knuckles of a hinge, the tool comprising:

a tube having a bore and a slotted opening in a side of the tube connecting with the bore and parallel thereto, wherein the bore extends from one end of the tube to another end of the tube, and wherein the bore includes a diameter sufficient to permit telescoping the tube onto the plurality of knuckles;

a stop located along one end of the tube and perpendicular thereto; and at least one additional bore located along an outside surface of the tube and opposite the slotted opening, wherein the at least one additional bore is configured to receive a leveraging tool.

9. The tool of claim 8, further comprising:

an insert selected to provide a non-marring surface, the insert having an insert bore and an insert slotted opening in an insert side of the insert connecting with the insert bore and parallel thereto, wherein the insert bore extends from one end of the insert to another end of the insert, wherein the insert bore includes an insert diameter sufficient to permit telescoping the insert onto the plurality of knuckles, and wherein the insert includes an outer diameter sufficient to permit telescoping the insert into the bore of the tube.

10. The tool of claim 9, wherein the insert is selected from a material selected from the group consisting of: a polymeric material, a brass material, an aluminum material, and a rubberized material.

11. The tool of claim 8, wherein the hinge is a door hinge.

12. A method for aligning a swage of each one of a pair of hinge plates of a hinge with one another comprising:

providing a tool, the tool comprising, a tube having a bore and a slotted opening in a side of the tube connecting with the bore and parallel thereto, wherein the bore extends from one end of the tube to another end of the tube, and wherein the bore includes a diameter sufficient to permit telescoping the tube onto a plurality of knuckles of the hinge, a stop located along one end of the tube and perpendicular thereto, and at least one pair of flattened surfaces formed along an outside surface of the tube and opposite one another, wherein the at least one pair of flattened surfaces are configured to receive a leveraging tool;

telescoping the tool onto the plurality of knuckles until the stop contacts a topmost knuckle;

providing the leveraging tool;

locating the leveraging tool along the at least one pair of flattened surfaces; and applying a directional force to the leveraging tool sufficient to deform the plurality knuckles thereby aligning the swage.

13. The method of claim 12 further comprising:

removing the tool from the hinge.

14. The method of claim 12, further comprising:

before the telescoping the tool onto the plurality of knuckles, telescoping an insert into the tool, the insert selected to provide a non-marring surface, the insert having an insert bore and an insert slotted opening in an insert side of the insert connecting with the insert bore and parallel thereto, wherein the insert bore extends from one end of the insert to another end of the insert, wherein the insert bore includes an insert diameter sufficient to permit telescoping the insert onto the plurality of knuckles, and wherein the insert includes an outer diameter sufficient to permit telescoping the insert into the bore of the tube.

* * * * *